US009887054B2

(12) United States Patent
Tsutsumi et al.

(10) Patent No.: US 9,887,054 B2
(45) Date of Patent: Feb. 6, 2018

(54) ELECTROMAGNETIC CONTACTOR HAVING SNAP-FIT SECTION COUPLING FRAMES

(71) Applicant: FUJI ELECTRIC FA COMPONENTS & SYSTEMS CO., LTD., Tokyo (JP)

(72) Inventors: Takashi Tsutsumi, Kounosu (JP); Masaaki Watanabe, Kounosu (JP); Hideki Daijima, Kounosu (JP); Shota Shiinoki, Kounosu (JP)

(73) Assignee: FUJI ELECTRIC FA COMPONENTS & SYSTEMS CO., LTD., Tokyo (JP)

( * ) Notice: Subject to any disclaimer, the term of this patent is extended or adjusted under 35 U.S.C. 154(b) by 0 days.

(21) Appl. No.: 15/185,450

(22) Filed: Jun. 17, 2016

(65) Prior Publication Data

US 2016/0293366 A1 Oct. 6, 2016

Related U.S. Application Data

(63) Continuation of application No. PCT/JP2015/001949, filed on Apr. 7, 2015.

(30) Foreign Application Priority Data

May 20, 2014 (JP) ..... 2014-104751

(51) Int. Cl.
*H01H 50/02* (2006.01)
*H01H 50/04* (2006.01)

(52) U.S. Cl.
CPC ..... *H01H 50/02* (2013.01); *H01H 50/045* (2013.01); *H01H 2050/046* (2013.01)

(58) Field of Classification Search
CPC ..... H01H 50/02; H01H 2050/046; H01H 50/045; H01H 50/68
See application file for complete search history.

(56) References Cited

U.S. PATENT DOCUMENTS 4,506,245 A * 3/1985 Lerude ..... H01H 50/045 200/50.32
5,848,719 A * 12/1998 Goldenberg ..... H01M 2/1022 220/281

(Continued)

FOREIGN PATENT DOCUMENTS

CN 201146156 Y 11/2008
JP 2006-216437 8/2006

(Continued)

OTHER PUBLICATIONS

International Search Report dated May 19, 2015, in corresponding International Application No. PCT/JP2015/001949.

(Continued)

*Primary Examiner* — Bernard Rojas

(57) ABSTRACT

The electromagnetic contactor includes a first frame in which an operation electromagnet is mounted; a second frame in which a contact mechanism is mounted; and a snap-fit section that is made up of a fitting protruding section and a hook section formed to one and the other of the first and second frame, respectively, the hook section fitting to the fitting protruding section. The hook section has a flexible projecting plate section formed in a projecting manner to an open end of either the first or second frame and a fitting section formed at a tip of the flexible projecting plate section, the fitting section fitting to the fitting protruding section. The flexible projecting plate section is provided with elasticity that fits the fitting section to a base side of the (Continued)

fitting protruding section in accordance with progress of wear between the fitting section and the fitting protruding section.

2 Claims, 7 Drawing Sheets

(56) References Cited

U.S. PATENT DOCUMENTS

| | | | | |
|---|---|---|---|---|
| 8,487,725 | B2 * | 7/2013 | Takaya | H01H 9/043 335/201 |
| 8,724,318 | B2 * | 5/2014 | Liang | G06F 1/1616 361/679.02 |
| 2012/0056701 | A1 | 3/2012 | Takaya et al. | |
| 2015/0380180 | A1 * | 12/2015 | Tian | H01H 9/20 200/293 |

FOREIGN PATENT DOCUMENTS

| | | |
|---|---|---|
| JP | 2009-9813 | 1/2009 |
| JP | 2011-44276 | 3/2011 |

OTHER PUBLICATIONS

International Preliminary Report on Patentability dated Dec. 1, 2016 in corresponding to International Patent Application No. PCT/JP2015/001949.

Chinese Office Action dated Apr. 1, 2017 in corresponding Chinese Application No. 201580003292.7.

* cited by examiner

ELECTROMAGNETIC CONTACTOR HAVING SNAP-FIT SECTION COUPLING FRAMES

CROSS-REFERENCE TO RELATED APPLICATIONS

This application is a continuation application filed under 35 U.S.C. § 111(a), of International Application PCT/JP2015/001949, filed Apr. 7, 2015, and claims foreign priority benefit to Japanese Patent Application No. 2014-104751, filed May 20, 2014, the contents of which are incorporated herein by reference.

TECHNICAL FIELD

The present invention relates to an electromagnetic contactor in which a first frame in which an operation electromagnet is mounted and a second frame in which a contact mechanism is mounted are coupled to each other.

BACKGROUND ART

As an electromagnetic contactor of such a type, electromagnetic contactors disclosed in PTLs 1 and 2 have been proposed. An electromagnetic contactor disclosed in PTL 1 is configured to couple, by a bolt, a first frame serving as a lower frame into which a fixed core, an operation coil, and so on, of an operation electromagnet are incorporated to a second frame serving as an upper frame into which a contact mechanism, a contact support, a movable core of the operation electromagnet, and so on, are incorporated.

An electromagnetic contactor disclosed in PTL 2 is configured to provide a joining section between a first frame serving as a lower frame that contains a fixed core and a second frame serving as an upper frame that contains a movable core, fixed contacts, and movable contacts with a clamp wire spring to couple the first frame to the second frame, and to couple the first frame to the second frame by the clamp wire spring.

CITATION LIST

Patent Literature

PTL 1: JP 2006-216437 A
PTL 2: JP 2009-009813 A

SUMMARY

Technical Problem

However, in the electromagnetic contactors disclosed in the above-described PTLs 1 and 2, the first frame serving as a lower frame and the second frame serving as an upper frame are coupled by bolting or by using a clamp wire spring.

Therefore, although the first frame and the second frame can be fixed to each other firmly by a bolt or a clamp wire spring, use of a bolt or a clamp wire spring is required for the coupling of the first frame and the second frame, which causes an unsolved problem of an increase in the number of components.

Recently, first frames and second frames of electromagnetic contactors have been formed by injection-molding fiber-reinforced thermoplastic resin, which is reinforced by glass fiber or the like, and coupling a first frame to a second frame in a snap-fit manner has been conceived.

However, it is difficult to secure toughness of fiber-reinforced thermoplastic resin, and wear of a snap-fit section progresses due to vibration produced in changing an operation electromagnet into a released state by switching the operation electromagnet from an excited state to a non-excited state to separate movable contacts from fixed contacts of the electromagnetic contactor itself and, thus, looseness is produced to the snap-fit section, which causes another unsolved problem of being unable to secure durability.

Accordingly, the present invention is made by focusing on the above-described unsolved problems in the conventional examples, and an object of the present invention is to provide an electromagnetic contactor that is capable of suppressing looseness due to wear of a snap-fit section coupling a first frame to a second frame from being produced.

Solution to Problem

In order to achieve the object mentioned above, according to an aspect of the present invention, there is provided an electromagnetic contactor, including: a first frame in which an operation electromagnet is mounted; a second frame in which a contact mechanism is mounted; and a snap-fit section that is made up of a fitting protruding section and a hook section formed to one and the other of the first frame and the second frame, respectively, the hook section fitting to the fitting protruding section. The hook section has a flexible projecting plate section formed in a projecting manner to an open end of either the first frame or the second frame and a fitting section formed at a tip of the flexible projecting plate section, the fitting section fitting to the fitting protruding section. The flexible projecting plate section is provided with elasticity that fits the fitting section further to a base side of the fitting protruding section in accordance with progress of wear between the fitting section and the fitting protruding section.

Advantageous Effects of Invention

According to the present invention, even when wear progresses between a fitting section of a hook section and a fitting protrusion, which forms a snap-fit section that couples a first frame in which an operation electromagnet is mounted to a second frame in which a contact mechanism is mounted, it is possible to maintain a fitting state between the fitting section of the hook section and the fitting protruding section, and to improve durability in the case of coupling the first frame to the second frame in a snap-fit manner.

DESCRIPTION OF EMBODIMENTS

Hereinafter, an embodiment of the present invention will be described with reference to the drawings.

Figure 1:
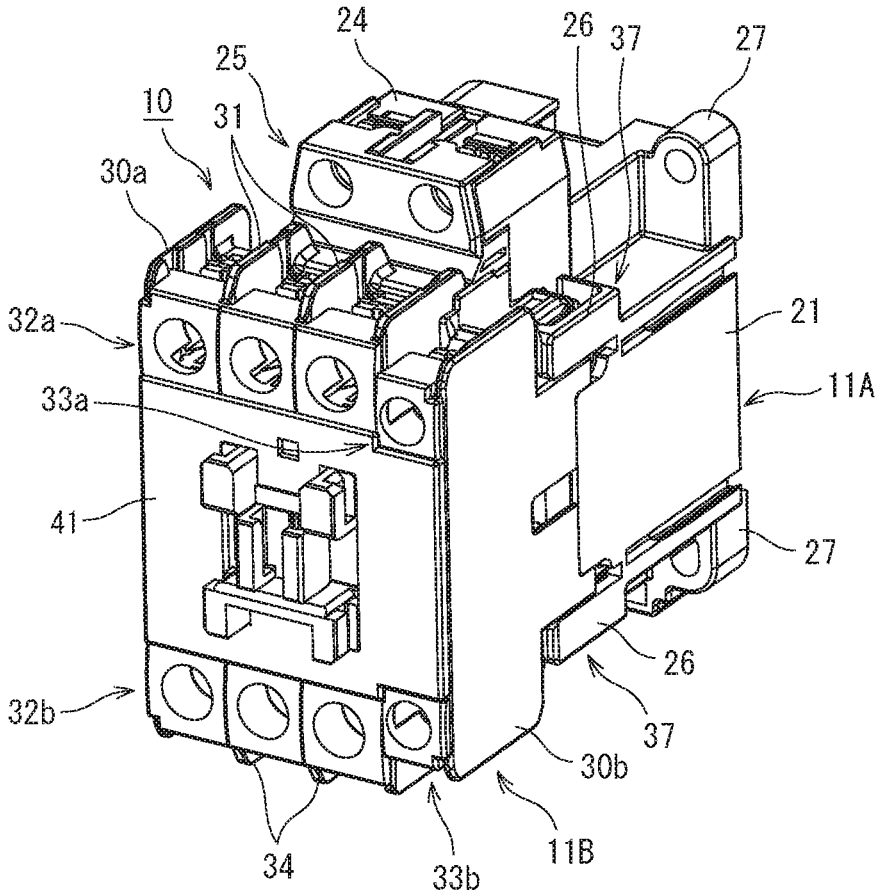
FIG. 1 is an external perspective view illustrating an electromagnetic contactor according to the present invention.
Figure 2:
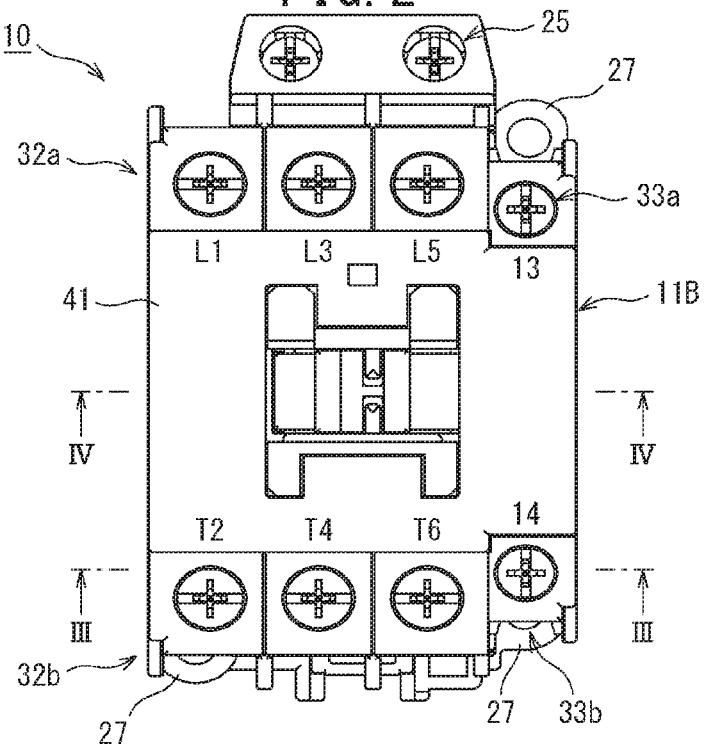
FIG. 2 is a front view of FIG. 1.

As illustrated in FIG. 1, an electromagnetic contactor 10 according to the present invention is made up of a first frame 11A and a second frame 11B coupled to each other, both of which are formed by, for example, injection-molding fiber-reinforced thermoplastic resin, with which glass fibers or the like are mixed.

Figure 3:
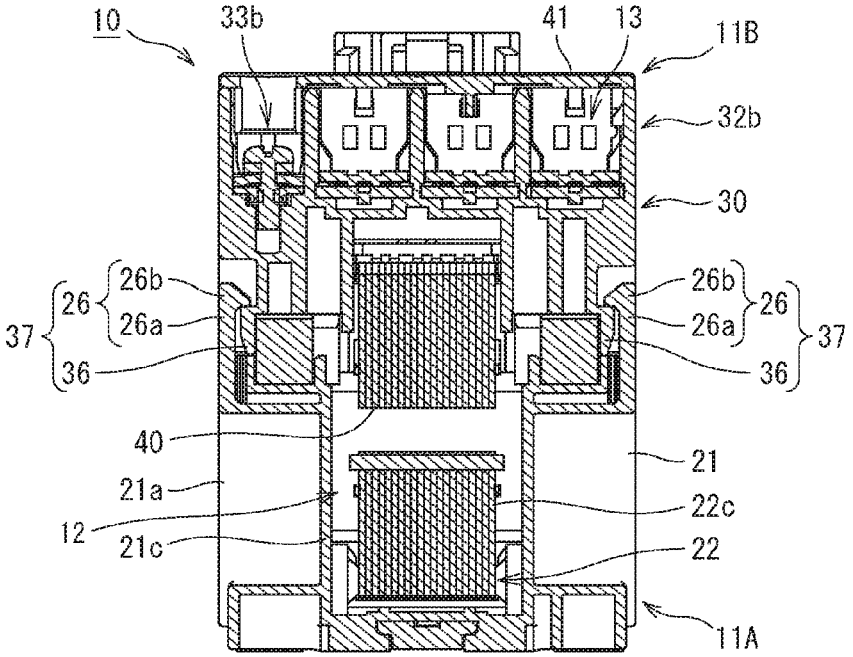
FIG. 3 is a cross-sectional view taken along the line III-III in FIG. 2.
Figure 4:
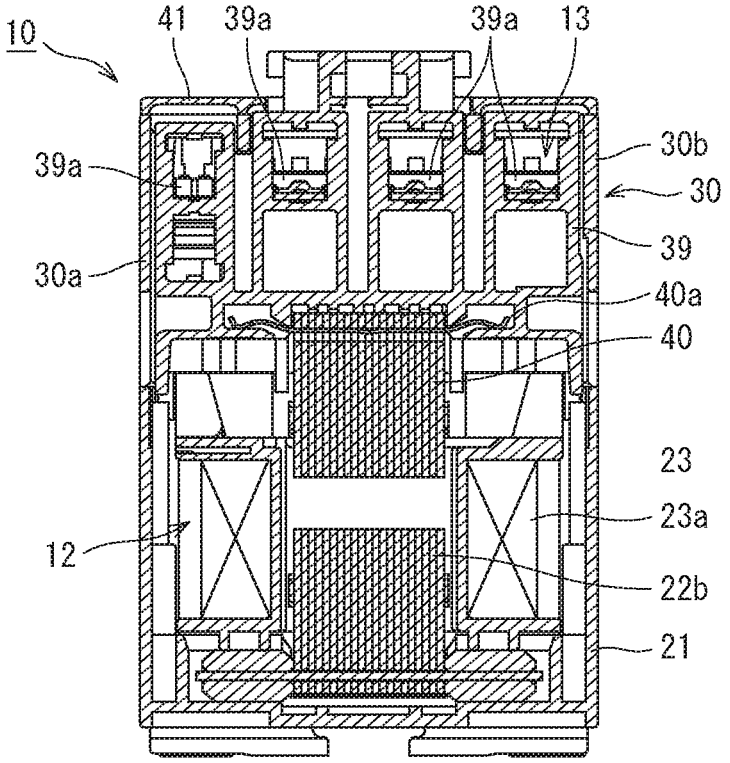
FIG. 4 is a cross-sectional view taken along the line IV-IV in FIG. 2.

In the first frame 11A, an operation electromagnet 12 that is made up of, for example, an AC electromagnet is mounted, as illustrated in FIGS. 3 and 4. In the second frame 11B, a contact mechanism 13 that is on/off-driven by the operation electromagnet 12 is mounted, as illustrated in FIGS. 3 and 4.

Figure 6A:
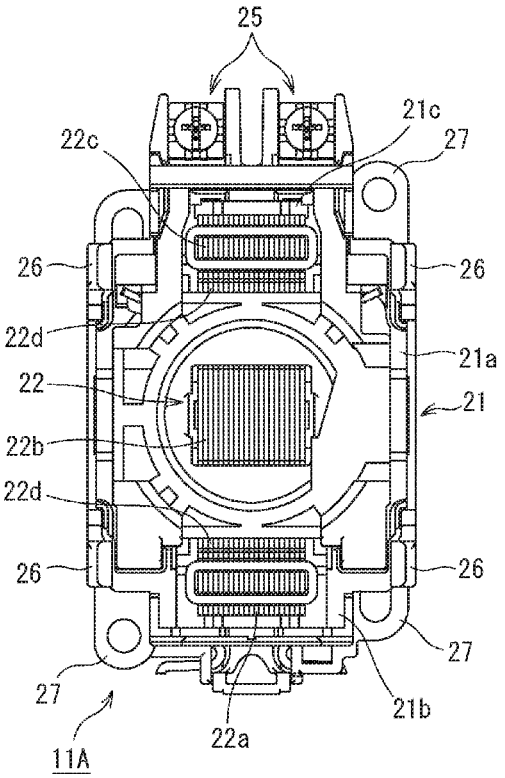
FIGS. 6A, 6B, and 6C are a front view, a side view, and a plan view of the first frame, respectively.
Figure 6B:
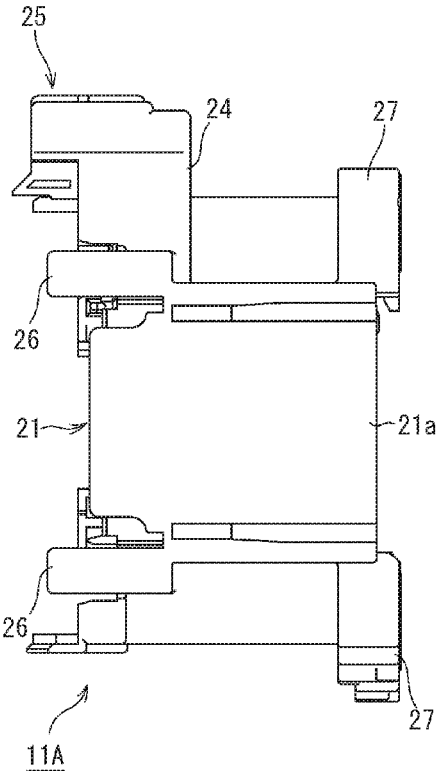
Figure 6C:
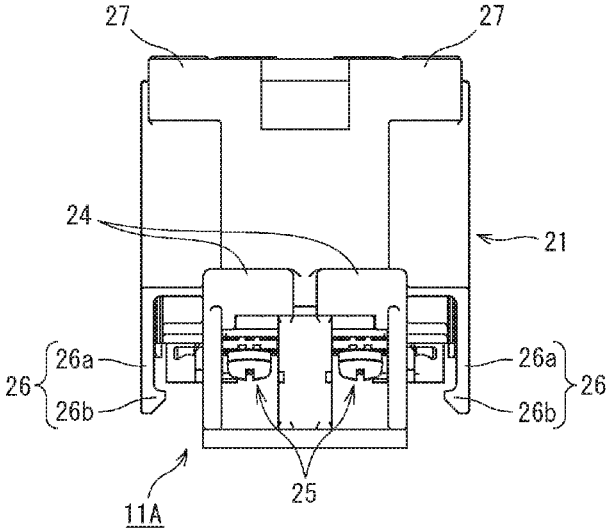

The first frame 11A has a bottomed angular cylindrical section 21 that houses the operation electromagnet 12. As illustrated in FIG. 6A when viewed from the front, the bottomed angular cylindrical section 21 is made up of a wide width section 21*a* in the middle and narrow width sections 21*b* and 21*c* that are formed to one pair of opposing side walls, for example, the upper and lower side walls, of the wide width section 21*a* in a line-symmetric manner with respect to the vertical center line of the wide width section 21*a* so as to be continuous with the wide width section 21*a*. On the bottom between the narrow width section 21*b* and the narrow width section 21*c* that sandwich the wide width section 21*a*, an E-shaped fixed core 22 is mounted with protruding sections 22*a* to 22*c* facing the front and a coupling section 22*d* contacting the bottom.

To the middle protruding section 22*b* of the fixed core 22, a spool 23 around which an excitation coil 23*a* is wound is mounted, as illustrated in FIGS. 4 and 6A to 6C. To the spool 23, coil terminals 25, which are fixed to a terminal block 24 that protrudes outward from one narrow width section 21*b* of the first frame 11A, are formed in one body.

To both end sections on the narrow width sections 21*b* and 21*c* sides of the front ends of the other pair of opposing side walls, for example, the right and left side walls, of the wide width sections 21*a* of the first frame 11A, for example, four hook sections 26 that extend to the front are formed, as illustrated in FIGS. 3 and 4.

Figure 8A:
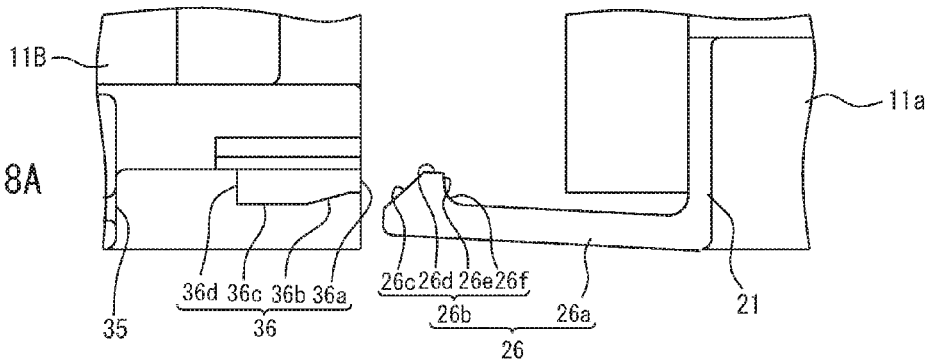
FIGS. 8A to 8D are enlarged cross-sectional views illustrating a snap-fit section.

Each hook section 26 is made up of a flexible projecting plate section 26*a* that extends from the front end of the wide width section 21*a* to the front, has flexibility, and has a relatively wide width and a fitting section 26*b* formed to the inner side of the tip portion of the flexible projecting plate section 26*a*, as illustrated in an enlarged manner in FIG. 8A.

Each fitting section 26*b* is formed into a cross-sectional trapezoidal shape with an inclined surface 26*c* that increases in thickness along the direction from the front end of the flexible projecting plate section 26*a* toward the rear side, that is, the base side of the flexible projecting plate section 26*a*, a level surface 26*d* that extends rearward slightly from the rear end of the inclined surface 26*c*, a fitting surface 26*e* that extends from the rear end of the level surface 26*d* toward the flexible projecting plate section 26*a* in the direction orthogonal to the flexible projecting plate section 26*a* to approximately half the thickness of the fitting section 26*b*, and a circular arc surface 26*f* that is made up of a round chamfer continuously connected to the outer side of the fitting surface 26*e*.

Each hook section 26 is formed integrally with the open end face of the first frame 11A in injection-molding fiber-reinforced thermoplastic resin, and the thickness of the flexible projecting plate section 26*a* being thin causes the flexible projecting plate section 26*a* to extend in an inwardly inclined manner due to residual stress after injection molding.

Therefore, to fit a hook section 26 to a fitting protruding section 36 as described later, the hook section 26 is fitted to the fitting protruding section 36 with the flexible projecting plate section 26*a* thereof being bent outward. Thus, elasticity that biases the fitting section 26*b* to the base side of the fitting protruding section 36 is provided to the flexible projecting plate section 26*a*.

To the four corners of the bottom of the bottomed angular cylindrical section 21 of the first frame 11A, mounting plate sections 27 each of which has a mounting hole are formed.

Figure 7A:
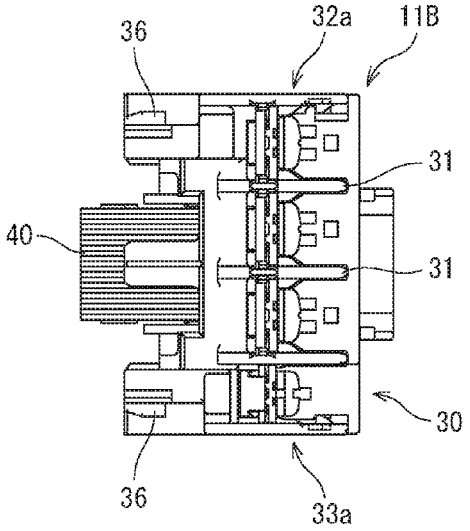
FIGS. 7A, 7B, and 7C are a plan view, a side view, and a rear view of the second frame, respectively.
Figure 7B:
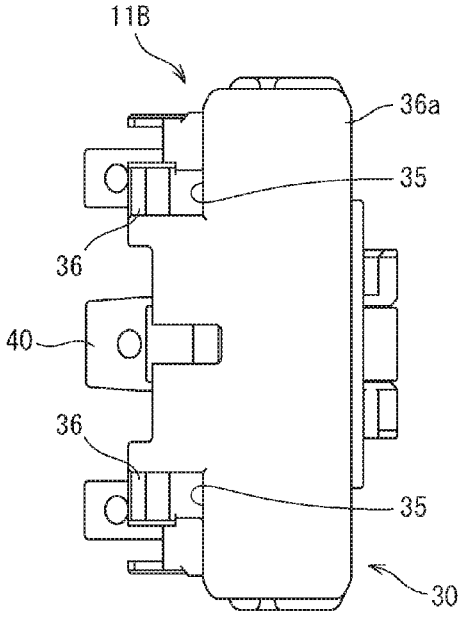
Figure 7C:
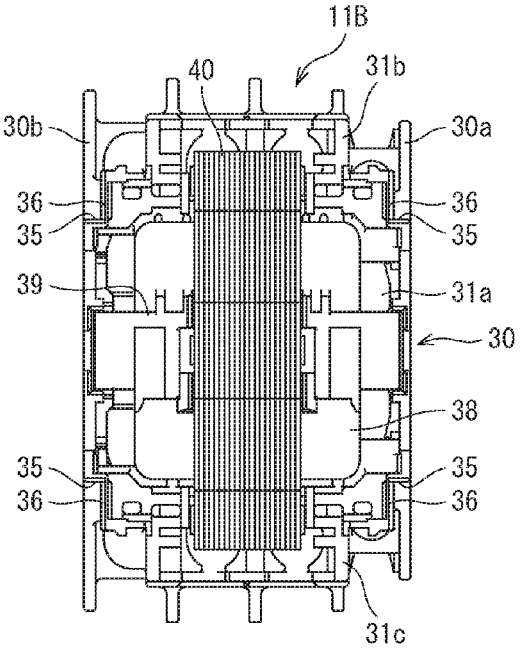

The second frame 11B includes an angular cylinder section 30 the shape of which on the coupling section side at which the second frame 11B is coupled to the first frame 11A is identical to the shape of the bottomed angular cylindrical section 21 of the first frame 11A, as illustrated in FIGS. 7A to 7C. The angular cylinder section 30 has, as with the bottomed angular cylindrical section 21, a wide width section 31*a* and narrow width sections 31*b* and 31*c* that are continuous with the wide width section 31*a*.

Figure 5:
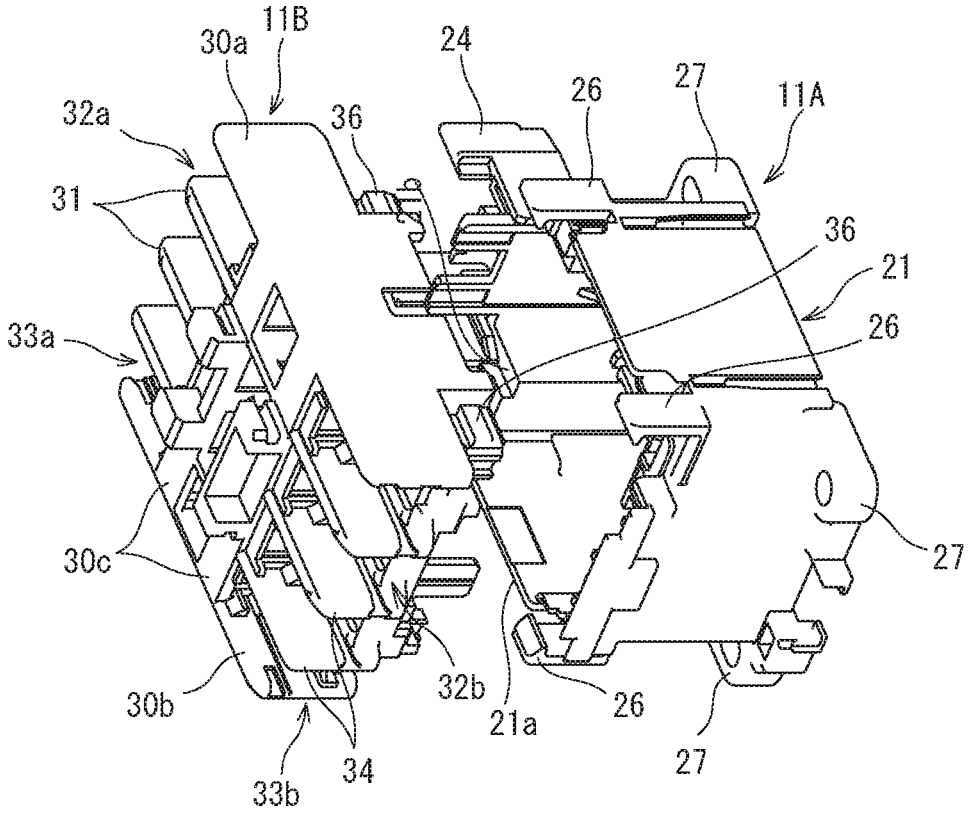
FIG. 5 is an exploded perspective view illustrating a state in which a first frame and a second frame are separated from each other.

The angular cylinder section 30 also has opposing side face plate sections 30*a* and 30*b* with which the narrow width sections 31*b* and 31*c* are not continuous and that extend to the opposite side to the coupling section side, as illustrated in FIG. 5. Middle sections of the extension end sections of the opposing side face plate sections 30*a* and 30*b* are bridged by coupling plate sections 30*c*. On the upper side of the coupling plate sections 30*c*, a plurality of, for example, three partition walls 31 that partition the interspace between the opposing side faceplate sections 30*a* and 30*b* into parallel subspaces are formed, and main circuit power supply side terminal sections 32*a* and an auxiliary terminal section 33*a* are mounted in the subspaces.

On the upper side of the coupling plate sections 30*c*, a plurality of, for example, three partition walls 34 that partition the interspace between the opposing side faceplate sections 30*a* and 30*b* into parallel subspaces are formed, and main circuit load side terminal sections 32*b* and an auxiliary terminal section 33*b* are mounted in the subspaces.

Further, to the opposing side face plate sections 30*a* and 30*b*, recessed sections 35 that open the side faces from the lower end side are formed at four locations opposed to the hook sections 26 of the first frame 11A, and, on the lower end side of the base of each recessed section 35, a fitting protruding section 36 to which the fitting section 26*b* of a corresponding hook section 26 formed to the first frame 11A is fitted from the outer side is formed.

Each recessed section 35 has a tool insertion space section 35*a* formed on the front end side thereof when the fitting section 26*b* of a hook section 26 is locked to a fitting protruding section 36, as illustrated in FIGS. 8A to 8D. By using a flat-blade screwdriver inserted into the tool insertion space section 35*a*, the locking state between the fitting section 26*b* of the hook section 26 and the fitting protruding section 36 can be released.

Each fitting protruding section 36 includes a rear end surface 36*a* that is flush with the rear end surface of a recessed section 35, an inclined surface 36*b* that is formed in such a way as to gradually increase in thickness outward along the direction from the outer end of the rear end surface 36*a* toward the front, a level surface 36*c* that extends from the outer side end section of the inclined surface 36*b* to the front, and a fitting surface 36*d* that extends from the front end of the level surface 36*c* toward the base side of the recessed section 35, as illustrated in an enlarged manner in FIG. 8A.

A snap-fit section 37 is made up of a hook section 26 formed to the first frame 11A and a fitting protruding section 36 formed to the second frame 11B.

An arc-extinguishing chamber 38 is formed behind the coupling plate sections 30*c*, and, inside the arc-extinguishing chamber 38, a contact support 39 that holds movable contacts 39*a* is held slidably in the front and rear direction. To the rear face side of the contact support 39, a movable core 40 that is opposed to the fixed core 22 is coupled by a coupling spring 40*a*, as illustrated in FIG. 3, and, between the movable core 40 and the spool 23 of the first frame 11A, a not-illustrated return spring is arranged.

In addition, an arc-extinguishing cover 41 is arranged so as to cover the upper face, the front face, and the lower face of the coupling plate section 30*c*.

Figure 8B:
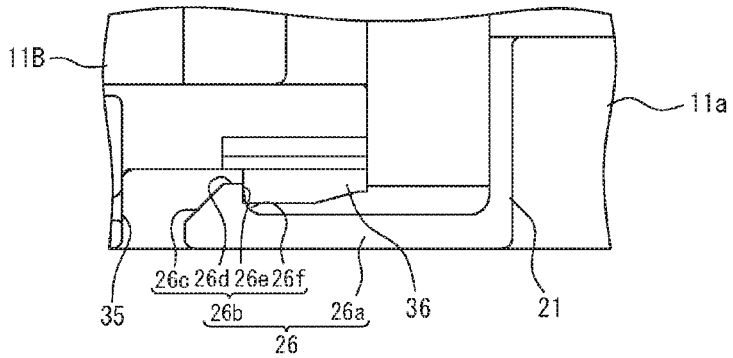
Figure 8C:
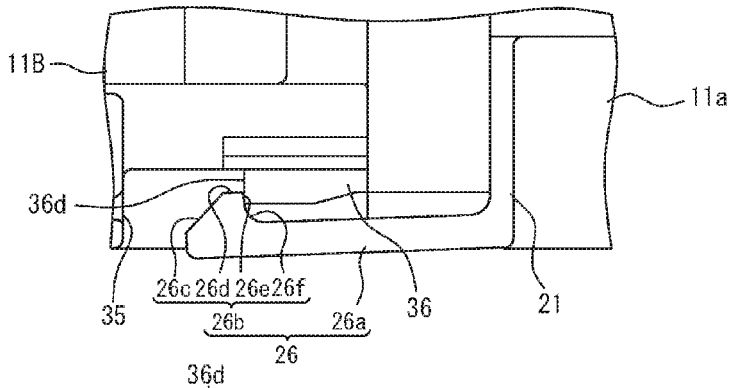

The first frame 11A and the second frame 11B are coupled into one body with the hook sections 26 of the first frame 11A being fitted to the fitting protruding sections 36 of the second frame 11B, as illustrated in FIG. 8C.

When the first frame 11A is coupled to the second frame 11B, the hook sections 26 formed to the first frame 11A are made to face the fitting protruding sections 36 formed to the second frame 11B in such a way that the coil terminal 25 protruding from the first frame 11A faces the main circuit power supply side terminal sections 32*a* and the auxiliary terminal section 33*a* of the second frame 11B.

When each hook section 26 is in a free state in which the hook section 26 is not fitted to a corresponding fitting protruding sections 36 of the second frame 11B, the flexible projecting plate section 26*a* thereof extends in an inwardly inclined manner at a predetermined angle due to residual stress in injection molding, as illustrated in FIG. 8A. When in this state, the inclined surface 26*c* of each fitting section 26*b* faces the ridgeline between the rear end surface 36*a* and the inclined surface 36*b* of a corresponding fitting protruding section 36 of the second frame 11B.

It is now assumed temporarily that, when the first frame 11A and the second frame 11B are coupled to each other by the hook sections 26 being fitted to the fitting protruding sections 36, there is no interference between the fitting sections 26*b* of the hook sections 26 and the fitting protruding sections 36. In this case, it is set so that, to cause the flexible projecting plate section 26*a* of each hook section 26 to be flush with side faces of the first frame 11A and the second frame 11B, the ridgeline between level surface 36*c* and the fitting surface 36*d* of the fitting protruding section 36 is located at a position inside the fitting section 26*b* anterior to the circular arc surface 26*f* continuously connected to the fitting surface 26*e* of each hook section 26, as illustrated in FIG. 8B.

Moving the second frame 11B toward the first frame 11A side with each hook section 26 facing a corresponding fitting protruding section 36 causes the inclined surface 26*c* of each hook section 26 to contact the ridgeline between the rear end surface 36*a* and the inclined surface 36*b* of a corresponding fitting protruding section 36. Further moving the second frame 11B toward the first frame 11A side causes the ridgeline between the inclined surface 26*c* and the level surface 26*d* of each hook section 26 to contact the inclined surface 36*b* of a corresponding fitting protruding section 36 to cause the flexible projecting plate section 26*a* of the hook section 26 to be bent outward.

Thereafter, the level surface 26*d* of each hook section 26 is engaged with the level surface 36*c* of a corresponding fitting protruding section 36, and the fitting surface 26*e* of the hook section 26 is locked to the fitting surface 36*d* of the fitting protruding section 36. At this time, when in a state in which no wear has occurred to the fitting surface 36*d* of each fitting protruding section 36, the first frame 11A and the second frame 11B are coupled to each other with the boundary position between the fitting surface 26*e* and the circular arc surface 26*f* of each hook section 26 contacting the ridgeline between the level surface 36*c* and the fitting surface 36*d* of a corresponding fitting protruding section 36 and the flexible projecting plate section 26*a*, for example, being bent outward, as illustrated in FIG. 8C.

However, when the electromagnetic contactor 10 is operated while the hook sections 26 are in a state of being fitted to the fitting protruding sections 36 as illustrated in FIG. 8C, in the case in which the excitation coil 23*a* of the operation electromagnet 12 is in a non-conducting state and thus the operation electromagnet 12 is in a non-excited state, the movable core 40 is biased to the front by the not-illustrated return spring. When in this state, the electromagnetic contactor 10 is in a released state, that is, a state in which the movable contacts 39*a* supported by the contact support 39 are separated from fixed contacts.

When the electromagnetic contactor 10 is in the released state, supplying AC power to the excitation coil 23*a* of the operation electromagnet 12 to change the operation electromagnet 12 into an excited state causes the movable core 40 to be attracted to the fixed core 22 against the return spring. Thus, the movable contacts 39*a* supported by the contact support 39, which is connected to the movable core 40 by the coupling spring 40*a*, contact the fixed contacts to electrically connect the main circuit power supply side terminal sections 32*a* and the auxiliary terminal section 33*a* to the main circuit load side terminal sections 32*b* and the auxiliary terminal section 33*b*, respectively, causing the electromagnetic contactor 10 to be brought to a conducting state.

When in the conducting state, breaking the AC power supply to the excitation coil 23*a* of the operation electromagnet 12 causes attractive force by the fixed core 22 to disappear to cause the movable core 40 to be returned to a released position in front by the return spring. On this occasion, vibration is generated due to the movable core 40 being returned to the released position by the return spring, and the vibration being transmitted to the first frame 11A and the second frame 11B causes wear to be produced to a contact section at which the fitting surface 26*e* and circular arc surface 26*f* of each hook section 26 contact the fitting surface 36*d* of a corresponding fitting protruding section 36, which is a coupling section of the first frame 11A and the second frame 11B.

The conducting state and the released state being repeated causes wear between the fitting surface 26*e* and circular arc surface 26*f* of each hook section 26 and the fitting surface 36*d* of a corresponding fitting protruding section 36 to progress.

The wear is produced to a ridgeline section between the level surface 36*c* and the fitting surface 36*d* of each fitting protruding section 36 substantially, and the ridgeline section becomes a circular arc surface that gradually increases in radius due to wear. In this case, since the flexible projecting plate section 26*a* of each hook section 26 originally extends in an inwardly inclined manner and is caused to be bent, as illustrated in FIG. 8A, the flexible projecting plate section 26*a* of each hook section 26 becomes bent inward by elastic force of the flexible projecting plate section 26*a* as wear progresses, causing the outer side surface of the flexible projecting plate section 26*a* to become flush with side faces of the first frame 11A and the second frame 11B, as illustrated in FIG. 8B.

Figure 8D:
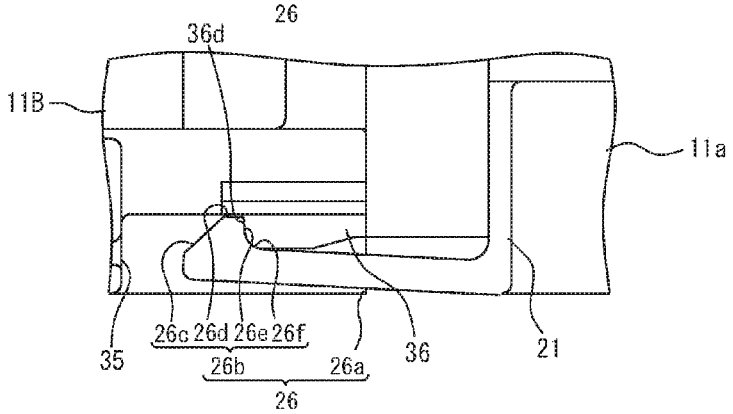

As wear between each hook section 26 and a corresponding fitting protruding section 36 further progresses, the flexible projecting plate section 26*a* of the hook section 26 is brought to a state of being inclined, as illustrated in FIG. 8D. When in this state, a ridgeline section between the inclined surface 26*c* and level surface 26*d* of each fitting section 26*b* is brought to a state of contacting the bottom of a corresponding recessed section 35, causing a further inclination of the flexible projecting plate section 26*a* to be restricted.

As described above, even when wear between each hook section 26 and a corresponding fitting protruding section 36 progresses, the flexible projecting plate section 26*a* becomes inclined in accordance with the wear by elastic force caused by bending of the flexible projecting plate section 26*a* of the hook section 26, causing the fitting section 26*b* of the hook section 26 to contact a position further on the base side of the fitting protruding section 36. Therefore, it is possible to suppress a gap from being produced between the fitting surface 26*e* and circular arc surface 26*f* of each hook section 26 and the ridgeline section between the level surface 36*c* and the fitting surface 36*d* of a corresponding fitting protruding section 36.

Therefore, even when a snap-fit connection is applied to the coupling of the first frame 11A to the second frame 11B, it is possible to surely suppress a coupling state between the first frame 11A and the second frame 11B from changing due to long-time use. Thus, it is possible to suppress occurrences of vibration sound that is produced between the first frame 11A and the second frame 11B when the electromagnetic contactor 10 is switched to the released state.

As a result, the durability of the electromagnetic contactor 10 can be improved, and, without a clamp wire spring or a bolt to coupling the first frame 11A to the second frame 11B being provided as in the afore-described conventional example, it is possible to securely couple the first frame 11A to the second frame 11B by the snap-fit sections, making it possible to decrease the number of components and to reduce the production cost of electromagnetic contactors.

In addition, since inclination due to residual stress after injection molding of fiber-reinforced thermoplastic resin is used to incline the flexible projecting plate section 26*a* of each hook section 26 inward, no special design is required to incline the flexible projecting plate section 26*a* , and neither is it required to design a shape that suppresses an inclination of the flexible projecting plate section 26*a* due to residual stress.

In the above-described embodiment, a case in which, when in a state in which no wear is produced, the flexible projecting plate section 26*a* is in a state of being bent outward, as illustrated in FIG. 8C, was described. However, the present invention is not limited to the above-described case, and it may be configured so that, when in a state in which no wear is caused, the outer side surface of each flexible projecting plate section 26*a* is in a state of being flush with side faces of the first frame 11A and the second frame 11B, as illustrated in FIG. 8B, and, alternatively, it may be configured so that the flexible projecting plate section 26*a* is positioned slightly on the inside of side faces of the first frame 11A and the second frame 11B. The essential thing is that the flexible projecting plate section 26*a* may be in a state of being bent outward.

Although, in the above-described embodiment, a case in which an AC electromagnet is used as the operation electromagnet 12 was described, the present invention is not limited to the case, and a non-polarized DC electromagnet or a polarized DC electromagnet can also be used. In such a case, a plunger may be coupled to the contact support 39 by a coupling spring.

In the above-described embodiment, a case in which the hook sections 26 and the fitting protruding sections 36 are formed to the first frame 11A and the second frame 11B, respectively, was described. However, the present invention is not limited to the above-described configuration, and the fitting protruding sections 36 and the hook sections 26 may be formed to the first frame 11A and the second frame 11B, respectively.

The number of arranged pairs of a hook section 26 and a fitting protruding section 36 is not limited to four pairs, and an arbitrary number of pairs, such as three pairs and five or more pairs, may be arranged.

Furthermore, although, in the above-described embodiment, a case in which an AC electromagnet is used as the operation electromagnet 12 was described, the present invention is not limited to the case, and a non-polarized DC electromagnet or a polarized DC electromagnet can also be used. In such a case, a plunger may be coupled to the contact support 39 by a coupling spring.

In the above-described embodiment, a case in which the hook sections 26 and the fitting protruding sections 36 are formed to the first frame 11A and the second frame 11B, respectively, was described. However, the present invention is not limited to the above-described configuration, and the fitting protruding sections 36 and the hook sections 26 may be formed to the first frame 11A and the second frame 11B, respectively.

The number of arranged pairs of a hook section 26 and a fitting protruding section 36 is not limited to four pairs, and an arbitrary number of pairs, such as three pairs and five or more pairs, may be arranged.

REFERENCE SIGNS LIST

10 Electromagnetic contactor
11A First frame
11B Second frame
12 Operation electromagnet
13 Contact mechanism
21 Bottomed angular cylindrical section
22 Fixed core
23 Spool
25 Coil terminal
26 Hook section
26*a* Flexible projecting plate section
26*b* Fitting section
26*c* Inclined surface
26*d* Level surface
26*e* Fitting surface
26*f* Circular arc surface
30 Angular cylinder section
32*a* Main circuit power supply side terminal section
32*b* Main circuit load side terminal section
33*a*, 33*b* Auxiliary terminal section
35 Recessed section
36 Fitting protruding section
36*a* Rear end surface
36*b* Inclined surface

36*c* Level surface
36*d* Fitting surface
37 Snap-fit section
39 Contact support
40 Movable core

The invention claimed is:

1. An electromagnetic contactor, comprising:

a first frame in which an operation electromagnet is mounted; a second frame in which a contact mechanism is mounted; and a snap-fit section that is made up of a fitting protruding section and a hook section formed to one and the other of the first frame and the second frame, respectively, the hook section fitting to the fitting protruding section, wherein the hook section has a flexible projecting plate section formed in a projecting manner to an open end of either the first frame or the second frame and a fitting section formed at a tip of the flexible projecting plate section, the fitting section fitting to the fitting protruding section, the flexible projecting plate section is provided with elasticity that fits the fitting section to a base side of the fitting protruding section, the fitting section of the hook section is formed into a trapezoidal shape with an inclined surface that gradually protrudes along a direction from the tip of the flexible projecting plate section toward the base side of the flexible projecting plate section, a level surface that extends from an inner side end of the inclined surface toward the base side in parallel to the flexible projecting plate section, a fitting surface that extends outward from an end section on the base side of the level surface to the flexible projecting plate section, and a circular arc surface that is continuously connected to the outer side of the fitting surface, the fitting protruding section is made up of a second inclined surface that, when being fitted to the hook section, is engaged with a boundary between the inclined surface and the level surface of the fitting section of the hook section to cause the flexible projecting plate section to be bent outward, a second level surface that is continuously connected to an outer side end section of the second inclined surface, and a second fitting surface that extends inward from an end face on an opposite side of the second level surface to the second inclined surface, and the first frame and the second frame are coupled to each other in a state where a boundary position between the fitting surface and the circular arc surface of the hook section is in contact with a ridgeline between the level surface and the fitting surface of the fitting protruding section.

2. The electromagnetic contactor according to claim 1, wherein either the first frame or the second frame, to which the hook section is formed, is formed by injection-molding fiber-reinforced thermoplastic resin to provide the hook section with elasticity using an inward inclination of the hook section caused by residual stress after injection molding.

* * * * *